US007431286B2

(12) United States Patent
Powell et al.

(10) Patent No.: US 7,431,286 B2
(45) Date of Patent: Oct. 7, 2008

(54) MEDIA STACK MEASUREMENT AND METHOD

(75) Inventors: Wade A. Powell, Meridian, ID (US); Ronald Slutz, Middleton, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 531 days.

(21) Appl. No.: 11/072,045

(22) Filed: Mar. 4, 2005

(65) Prior Publication Data

US 2006/0197273 A1 Sep. 7, 2006

(51) Int. Cl.
*B65H 1/08* (2006.01)

(52) U.S. Cl. ..... 271/148; 271/34; 271/152; 271/110

(58) Field of Classification Search ..... 271/34, 271/148, 152, 110
See application file for complete search history.

(56) References Cited

U.S. PATENT DOCUMENTS 4,313,669 A * 2/1982 Larson et al. ..... 396/661
4,349,186 A * 9/1982 Nakamura ..... 271/18
4,511,301 A * 4/1985 Kawano et al. ..... 414/790.2
4,919,412 A 4/1990 Weigel et al.
5,022,642 A * 6/1991 Hasegawa et al. ..... 271/10.12
5,114,306 A * 5/1992 Sjogren et al. ..... 414/790.4
5,219,154 A * 6/1993 Fukube et al. ..... 271/18.2
5,622,364 A * 4/1997 Dutton et al. ..... 271/117
5,696,690 A * 12/1997 Richardson et al. ..... 700/219
6,186,492 B1 * 2/2001 Dechau et al. ..... 271/30.1
6,279,896 B1 8/2001 Linder et al.
6,318,715 B1 11/2001 Froechte et al.
6,607,194 B2 8/2003 Moeller et al.
6,615,105 B2 * 9/2003 Masotta ..... 700/219
6,663,097 B2 12/2003 Bantle
6,837,490 B2 * 1/2005 Hirai et al. ..... 271/148
7,267,337 B2 * 9/2007 Moore et al. ..... 271/148
2001/0006271 A1 * 7/2001 Muller et al. ..... 271/148
2005/0110207 A1 * 5/2005 Moore et al. ..... 271/152

* cited by examiner

*Primary Examiner*—Patrick Mackey
*Assistant Examiner*—Prasad V Gokhale

(57) ABSTRACT

A system and method include a printer input, a feedhead assembly, first and second sensors and a controller. The printer input is configured to hold a stack of media. The first sensor is coupled to the feedhead assembly and configured to measure at a first location of the stack of media. The second sensor is coupled to the feedhead assembly and is configured to measure at a second location of the stack of media. The controller communicates with the feedhead assembly and the first and second sensors to calculate a curvature of the stack of media in the input feeder.

16 Claims, 3 Drawing Sheets

MEDIA STACK MEASUREMENT AND METHOD

CROSS-REFERENCE TO RELATED APPLICATIONS

This Patent Application is related to U.S. patent application Ser. No. 11/072,126 filed on even date herewith entitled ADAPTIVE PRINTING SYSTEM AND METHOD, commonly assigned to the same assignee as the present invention, and hereby incorporated by reference herein.

BACKGROUND

The present invention relates generally to the field of printing and more particularly to a system and method of effectively feeding media from input feeders of printing systems. For many printing systems, media on which printing is to occur is picked from an input feeder. Generally, a mechanism separates the sheet from a top of a stack of media such that it is fed into a marking engine of a printing system. On occasion there are failures in picking a sheet from a stack of media. Such failure would include a failure to pick the top sheet, a "no-pick," or picking multiple sheets of media at once, a "multi-pick." Both a no-pick and a multi-pick are undesired outcomes. In the case of a multi-pick, this can lead to physical media jams within the marking engine of a printing system and cause wasted media, while reducing throughput of the printing system. A no-pick results in no printing.

In some instances the condition of the media in the input feeder affects the ability of printing systems to minimize no-picks and multi-picks and related failures. Some printing systems have relied on the user of the system to ensure that the condition of the media is satisfactory for the printing system. Although such a system can prevent some paper jams, it is not effective, for example, when the user does not perceive a deficient condition in the media.

For these and other reasons, a need exists for the present invention.

SUMMARY

Exemplary embodiments of the present invention include a system and method for printing on media. The system and method include a printer input, a feedhead assembly, first and second sensors and a controller. The printer input is configured to hold a stack of media. The first sensor is coupled to the feedhead assembly and configured to measure at a first location of the stack of media. The second sensor is coupled to the feedhead assembly and is configured to measure at a second location of the stack of media. The controller communicates with the feedhead assembly and the first and second sensors to calculate a curvature of the stack of media in the input feeder.

DETAILED DESCRIPTION

In the following Detailed Description, reference is made to the accompanying drawings, which form a part hereof, and in which is shown by way of illustration specific embodiments in which the invention can be practiced. It is to be understood that other embodiments can be utilized and structural or logical changes can be made without departing from the scope of the present invention. The following Detailed Description, therefore, is not to be taken in a limiting sense, and the scope of the present invention is defined by the appended claims.

Figure 1:
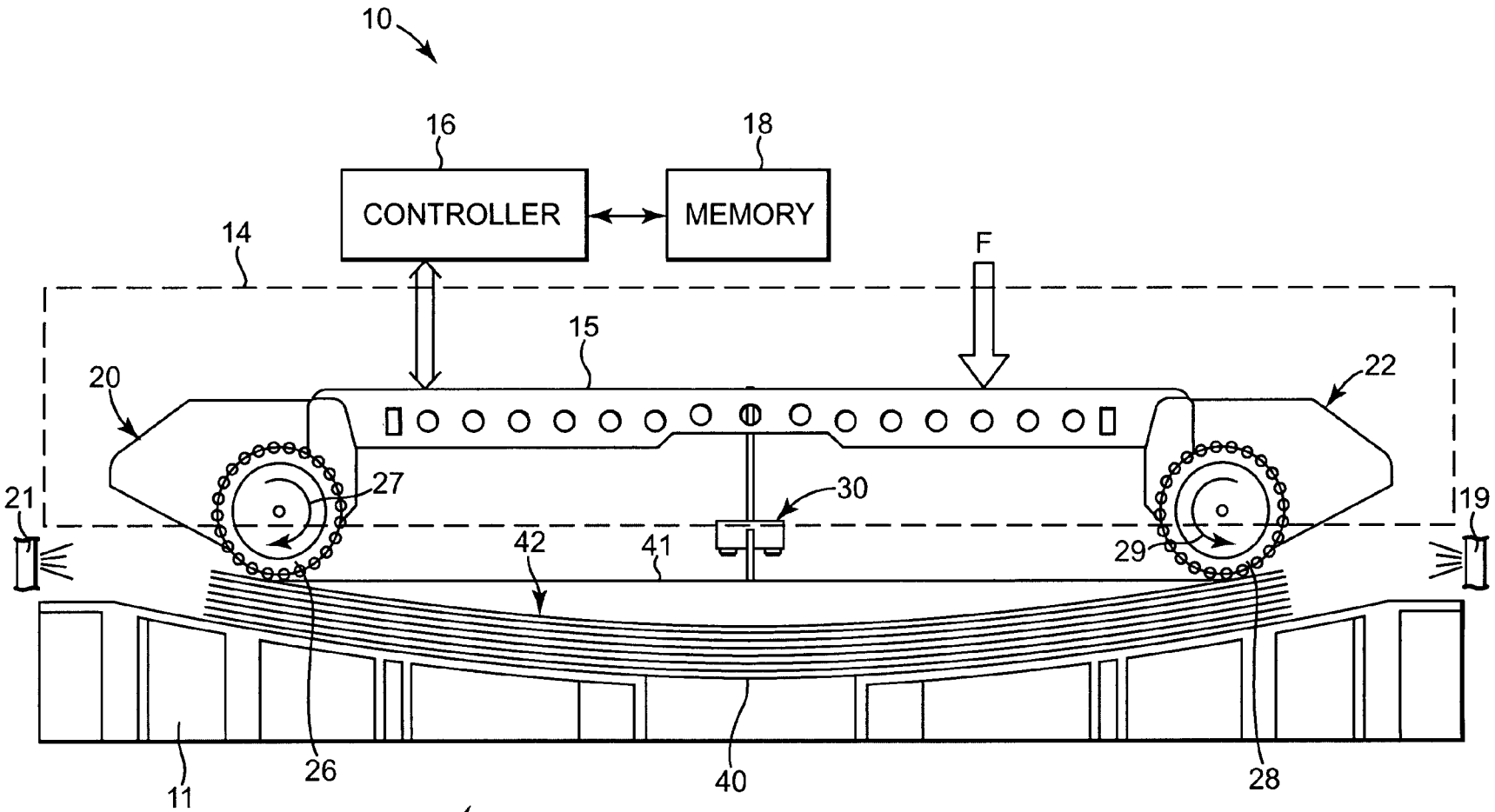
FIG. 1 illustrates a cross-sectional view of one embodiment of a media pick system that is part of a printing system according the present invention.

FIG. 1 illustrates one embodiment of a portion of printing system 10 in accordance with the present invention. Printing system 10 includes input feeder 12, feedhead assembly 14, controller 16, and memory 18. Feedhead assembly 14 further includes assembly bar 15, first roller assembly 20 and second roller assembly 22. First tractor roller 26 is mounted within first roller assembly 20 and second tractor roller 28 is mounted within second roller assembly 22. Media sensor 30 is also mounted on assembly bar 15 of feedhead assembly 14. Input feeder 12 includes a media tray 11 with a concave surface 40 that is configured to hold media 42, including a top sheet 41. Blowers 19 and 21 are configured to blow air into media 42.

In one embodiment, feedhead assembly 14 of printing system 10 is configured to pick a sheet from a stack of media 42 and make it ready to be delivered to a marking engine within printing system 10. Removing a sheet from a stack of media 42 in input feeder 12 and delivering the sheet to a marking engine of printing system 10 is referred to as a "pick". The amount of time that it takes to separate a sheet from a stack of media 42 and make it ready to be delivered to the printing engine is referred to as the "pick time" or the "separation time."

Figure 2:
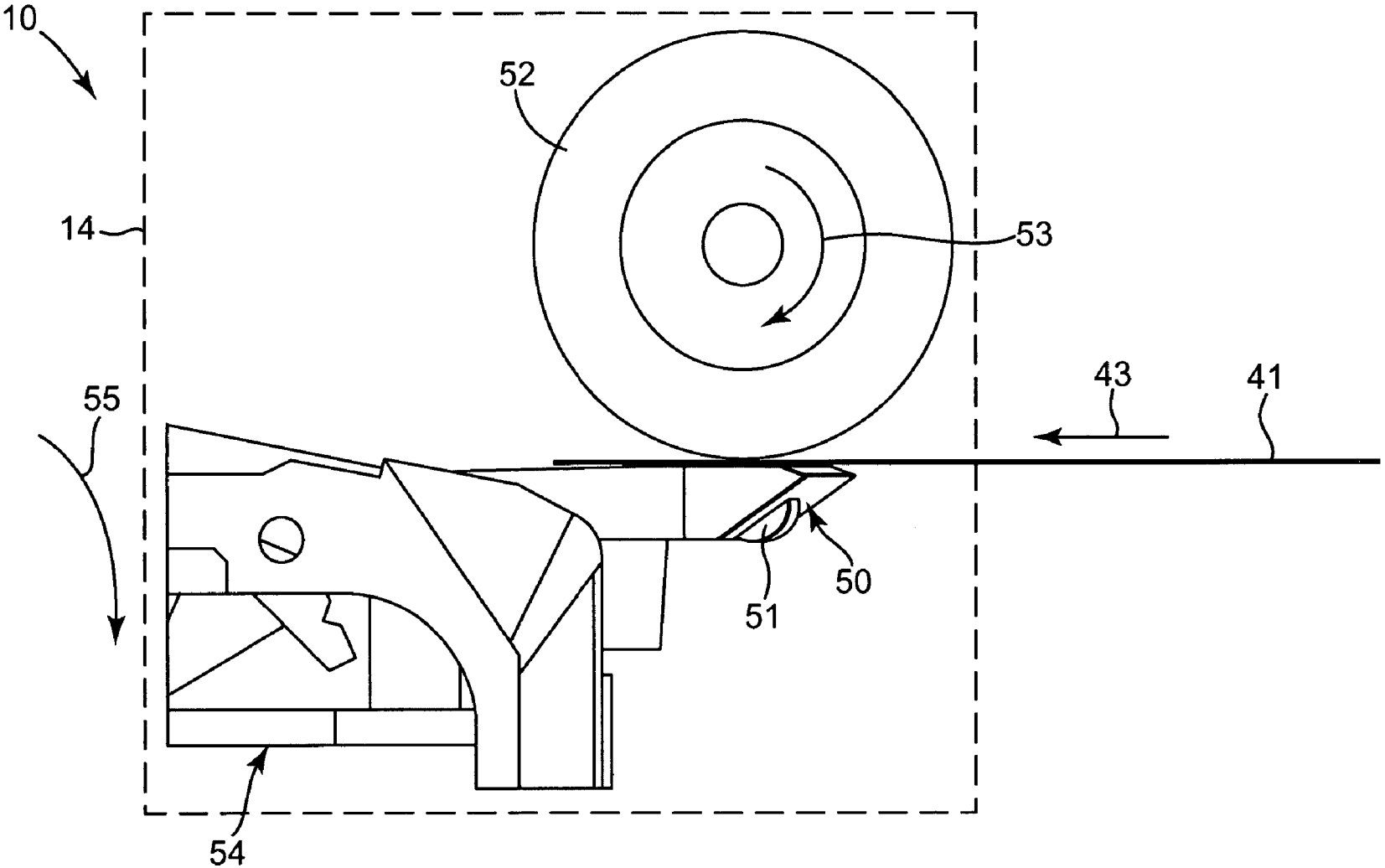
FIG. 2 illustrates a cross-sectional view of a portion of the media pick system illustrated in FIG. 1.

FIG. 2 illustrates an additional portion of printing system 10 in accordance with one embodiment of the present invention. FIG. 2 illustrates a cross-sectional view of a portion of printing system 10 that is taken perpendicular to that illustrated in FIG. 1. FIG. 2 illustrates carriage wedge 50, nip roller 51, exit roller 52, and exit assembly 54, which are also configured on feedhead assembly 14. (For ease of illustration, carriage wedge 50, nip roller 51, exit roller 52, and exit assembly 54 are not illustrated in FIG. 1). Carriage wedge 50 and nip roller 51 operate in conjunction with those portions of feedhead assembly 14 illustrated in FIG. 1 to remove sheets of media 42 from input feeder 12 and deliver the sheets of media 42 to the marking engine of printing system 10.

In operation of one embodiment of the present invention, feedhead assembly 14 picks a sheet from a stack of media 42 in input feeder 12 by first utilizing first and second tractor rollers 26 and 28. First and second tractor rollers 26 and 28 press down with a force F and rotate in the direction of the arrows 27 and 29, respectively (as indicated in FIG. 1). In one embodiment, first and second rollers 26 and 28 are further provided with a plurality of smaller rollers or bearings on their outer periphery. In this way, rotation of first and second tractor rollers 26 and 28 while pressing down in this way engages the top sheet 41 of a stack of media 42 that is placed in media tray 11. Since media tray 11 has concave surface 40, the media 42 that is placed there also has a concave bend that follows concave surface 40. As first and second tractor rollers 26 and 28 rotate as indicated and engage the top sheet 41 of media 42, they pull the edges outward thereby pulling the center of media 42 away from concave surface 40 and upward toward media sensor 30. Thus, the top sheet 41 of media 42 is moved from a relatively concave position to a more taut and planar position.

Once top sheet 41 of media 42 has reached a relatively planar position it impacts media sensor 30 (as illustrated in FIG. 1). As the top sheet 41 of the stack of media 42 moves up to impact media sensor 30, several sheets of media in a section just below the top sheet 41 toward the top of the stack of media 42 are all being lifted at varying rates. The top sheet 41 rises faster than the second sheet, which rises faster than the third sheet, and so on. After the top sheet 41 becomes flat and taut, and tractor rollers 26 and 28 are allowed to continue running for a period of time after the top sheet 41 is flat (also referred to as "overrun time"), the next lower sheets below the top sheet 41 begin to lower back down toward concave surface 40. Thus, the sheets just below the top sheet 41 separate further from the top sheet 41 providing space between the top and the next lower sheet.

Once the top sheet 41 of the stack of media 42 impacts media sensor 30 and sufficient space is established between the top and the next sheet (due to its falling back), carriage wedge 50 (illustrated in FIG. 2) deploys under the top sheet 41 of media 42. Then, exit roller 52 rotates in the direction indicated by arrow 53 thereby pinching top sheet 41 between exit roller 52 and nip roller 51 and moving it out of input feeder 12 in the direction indicated by arrow 43. In one embodiment, media 42 is sent to exit assembly 54, which is coupled to the marking engine of printing system 10. Also in one embodiment, the direction indicated by arrow 43 in FIG. 2 is perpendicular to the plane of the cross-section illustrated in FIG. 1. In one embodiment, the entire exit assembly 54, including carriage wedge 50, can be angled downward in the direction of arrow 55 such that it can be assured that carriage wedge 50 will deploy under the top sheet 41 of media 42.

Figure 3:
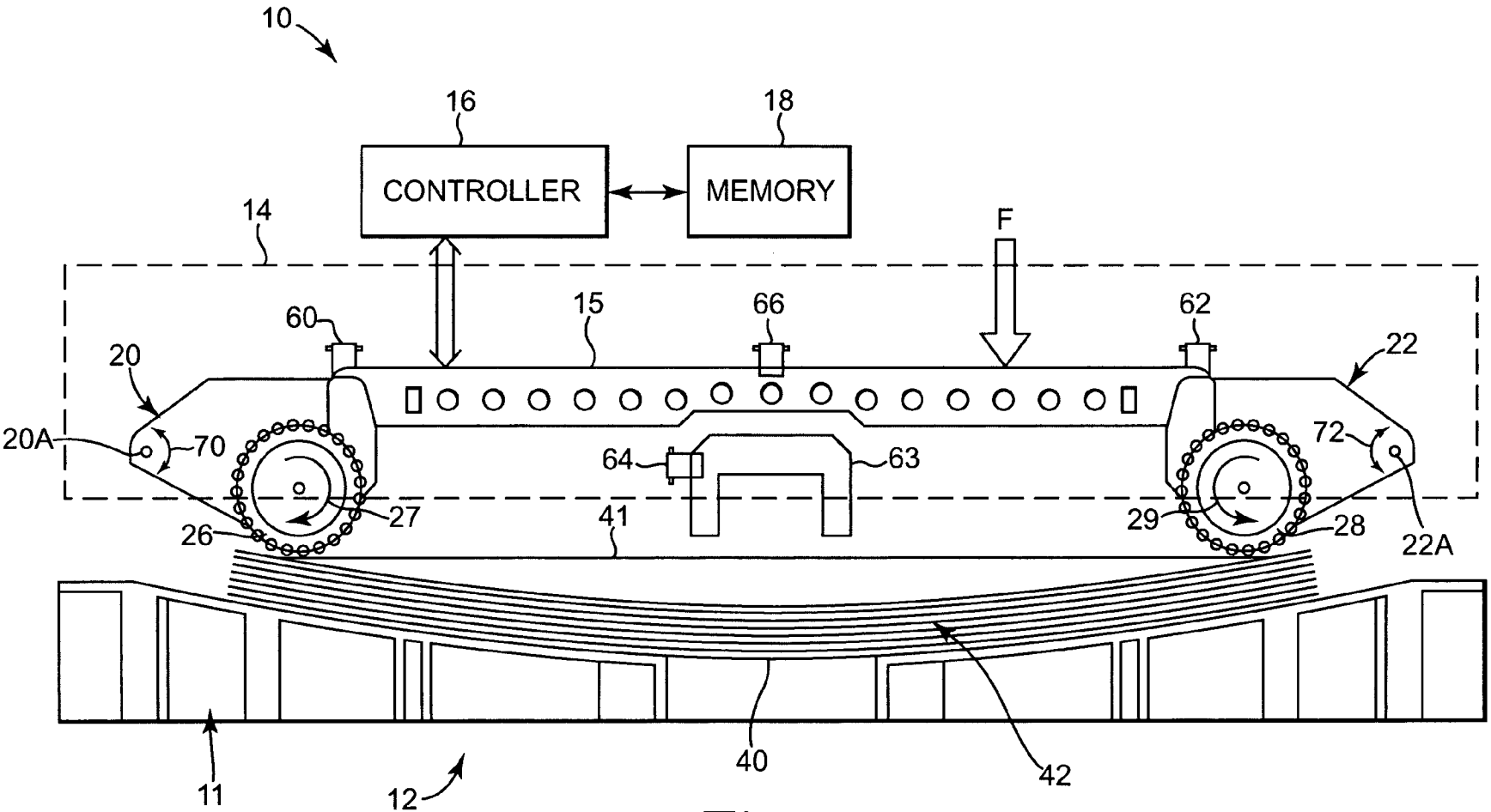
FIG. 3 illustrates a cross-sectional view of a media pick system with measurement sensors according to one embodiment of the present invention.

FIG. 3 illustrates printing system 10 with measurement sensors according to one embodiment of the present invention. Feedhead assembly 14 is illustrated in dashed lines. First and second roller assemblies 20 and 22 are coupled to assembly bar 15 and hinged relative to feedhead assembly 14 at pivots 20A and 22A, such that they can move up and down in the directions indicated by arrows 70 and 72. First and second sensors 60 and 62 are coupled to feedhead assembly 14 and configured to measure the movement of first and second roller assemblies 20 and 22 in the direction of arrows 70 and 72. Also, sensors 60 and 62 are coupled to controller 16 such that controller receives the measured movement. In addition, or as an alternative, third sensor 66 is fixed to feedhead assembly 14 near the center of feedhead bar 15 and configured to measure the movement of bar 15 at the center location.

A pusher 63 is also fixed to feedhead assembly 14 and configured to push down near the center of the stack of media 42. Pusher sensor 64 is coupled to pusher 63, and senses the movement of pusher 63 thereby measuring the height of media 42 toward its center. Pusher sensor 64 is similarly coupled to controller 16 such that controller receives any measured impact of media 42. (For ease of illustration, media sensor 30 is removed and not illustrated in FIG. 3, and pusher 63 is removed and not illustrated in FIG. 1).

In operation of one embodiment of printing system 10, media 42 is stacked in media tray 11 which has a concave surface 40. Thus, the stack of media 42 can also take on a curved shape generally following concave surface 40. Controller 16 measures the curvature of media 42 utilizing first and second sensors 60 and 62, and pusher sensor 64. In this way, one embodiment of printing system 10 first assesses the curvature of media 42 before printing a job in order to determine whether the curvature is within a certain range that is sufficient for proper operation of printing system 10. Ranges sufficient for proper operation of printing system 10 can be stored in memory 18. If it is found that the measured curvature is not within the stored range, an error or other appropriate warning message can be generated for the operator, or an adjustment can be made to operating system 10.

In operation of one embodiment of printing system 10, media tray 11 of input feeder 12 is filled with a stack of media 42. A motor coupled to media tray 11 then pushes media tray 11 upward toward feedhead assembly 14 after the stack of media 42 is placed within it. As media tray 11 is moved toward feedhead assembly 14, pusher 63 will impact against the center of the top of the stack of media 42 in media tray 11. Pusher sensor 64 will detect the movement of pusher 63 thereby detecting the height of the stack of media 42 at this center location. Similarly, first and second tractor rollers 26 and 28 will impact the top of the stack of media 42 in media tray 11 as it moves in that direction. As first and second tractor rollers 26 and 28 impact media 42, first and second roller assemblies 20 and 22 will pivot at locations 20A and 22A and move in the directions of arrows 70 and 72, which will be sensed by sensors 60 and 62. First and second sensors 60 and 62 will then detect the height of the stack of media 42 at these edge locations.

Controller 16 then receives the sensed information from first and second sensors 60 and 62 and pusher sensor 64. In this way, by using the relative heights at the edges of the media 42 (from the height of first and second roller assemblies 20 and 22 as sensed by sensors 60 and 62) and at the center of the media (from the height measured by pusher sensor 64), controller 16 then calculates the curvature of media 42 in input feeder 12.

In one embodiment, the curvature of media 42 affects how individual sheets are separated from the stack of top sheet 41. The curvature can affect the separation time and improper curvature can cause jams. For example, if the stack of media 42 is too flat, and does not follow the concave surface 40 of input feeder 12, in some cases a proper pick will not occur. When first and second tractor rollers 26 and 28 rotate and engage the top sheet 41 of a stack of media 42 moving it to a taut and planar position, if the stack of media 42 is already relatively flat, then there will not be significant separation between the top sheet 41 and the next lower sheets of media 42 in the stack. In this way, when carriage wedge 50 deploys under the top sheet 41, it will be difficult to ensure that carriage wedge 50 properly goes under the top sheet 41, but not under any other sheets. This can increase the risk of a multi-pick or media jam. In addition, in some cases there is not enough space, which could damage media 42. Similarly, if there is too much curvature in the media 42, feedhead assembly 14 can also have a difficult time separating the top sheet 41, thereby increasing the risk of picking difficulties.

By measuring media 42 curvature, printing system 10 allows warnings to be given to correct the curvature, allows adjustments to be made to accommodate for unexpected or varying curvature, and allows for a printing job to be delayed or stopped until the curvature is corrected.

In one case, controller 16 only uses the height of one of first or second roller assemblies 20 and 22 as sensed by sensors 60 or 62, and then calculates the curvature of media 42 from the edge height (from, for example, sensor 60) and the center height (from pusher sensor 64). In such an embodiment, only a sensor on one side or the other of the stack of media 42 would be needed. In an additional embodiment, third sensor 66 is used instead of either first or second sensors 60 and 62. Since sensor 66 monitors the height at the center of assembly bar 15, it provides an approximate average of the height at the edges of the stack of media 42.

In another embodiment, both the height of first and second roller assemblies 20 and 22 are independently sensed by sensors 60 or 62 by monitoring the relative motion of first and second assemblies 20 and 22 and feedhead assembly 14. Then, the independently measured height of first and second roller assemblies 20 and 22, which indicate the height of the stack of media 42 at its edges, are averaged. That average height from both edges of the stack of media 42 is then compared to the center height, which is measured by pusher sensor 64, to calculate the overall curvature of media 42. In this way, even where the curvature of media 42 is slightly shifted relative to the first and second roller assemblies 20 and 22, an accurate measurement is still achieved by averaging the two outer measurements, and then comparing the average to the center measurement.

In one embodiment, where the curvature measurement indicates that the curvature is not within an normal range for a printing job, printing system 10 will not process the printing job and issues a notice to the user. In another embodiment, printing system 10, upon finding that the curvature measurement is not within an normal range for a printing job, instructs the user to adjust the stack of media to push the center down or raise it up depending on the relative measurements. In the case of thicker media, the user can be instructed to hand bend the media in the center and return it to the input feeder 12 in order to get a better curvature measurement.

In other cases, the curvature measurement is used to adjust system parameters to adjust how media is processed with printing system 10. Since separation time can be affected by the curvature measurement, other system parameters that also affect separation time, such as those disclosed and discussed in related application ADAPTIVE PRINTING SYSTEM AND METHOD referred to above, can be adjusted to compensate for the effect of the curvature measurement.

Although specific embodiments have been illustrated and described herein, it will be appreciated by those of ordinary skill in the art that a variety of alternate and/or equivalent implementations can be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A system for printing on media, the system comprising:
a printer input configured to hold a stack of media;
means for measuring the stack of media at a first location thereby producing a first measurement indicative of the height of the media stack at a first and a second edge of the stack;
means for measuring the stack of media at a second location producing a second measurement indicative of the height of the media stack at a center of the stack; and
means for calculating a calculated curvature of the stack of media based on the first and second measurements of the stack of media.

2. The system of claim 1, wherein the printer input has a concave shape such that when the stack of media is placed in the printer input the stack of media also tends to form a concave shape.

3. The system of claim 1 further comprising a memory configured to hold a normal range of curvatures for stack of media and means for comparing the calculated curvature of the stack of media with the normal range of curvatures.

4. The system of claim 3, wherein the printing system issues an error message and does not allow printing when the calculated curvature of the stack of media is not within the normal range of curvatures.

5. The system of claim 3, wherein the printing system adjusts system parameters in order to compensate when the calculated curvature of the stack of media is not within the normal range of curvatures.

6. The system of claim 1 further comprising means for picking media from the printer input and delivering it to a printer marking engine.

7. A system for printing on media, the system comprising:
a printer input configured to hold a stack of media;
means for measuring the stack of media at a first location producing a first measurement;
means for measuring the stack of media at a second location producing a second measurement;
means for measuring the stack of media at a third location producing a third measurement; and
means for calculating a calculated curvature of the stack of media based on the first, second and third measurement;
wherein the second and third measurements at the second and third locations are averaged and the difference between first measurement at the first location and the average of the second and third measurements at the second and third locations is used to calculate the curvature of the stack of media.

8. A system for printing on media, the system comprising:
a printer input configured to hold a stack of media;
a feedhead assembly configured to pick media from the printer input and deliver it to a printer marking engine;
a first sensor coupled to the feedhead assembly and configured to measure a first height at a first location of the stack of media;
a second sensor coupled to the feedhead assembly and configured to measure a second height at a second location of the stack of media;
a third sensor coupled to the feedhead assembly and configured to measure a third height at a third location of the stack of media; and
a controller configured to communicate with the feedhead assembly and the first, second and third sensors to calculate a calculated curvature of the stack of media in the printer input based on the difference between the first measured height and an average of the second and third measured heights.

9. The system of claim 8, wherein the controller receives a first measurement at the first location from the first sensor, receives a second measurement at the second location from the second sensor, and calculates the curvature of the stack of media based upon the first and second measurements.

10. The system of claim 8, wherein the first location is at a center of the stack of media and wherein the second location is at a first edge of the stack of media.

11. The system of claim 8, wherein the printer input has a concave shape such that when the stack of media is placed in the printer input the stack of media also tends to form a concave shape.

12. The system of claim 8, wherein the third location is at a second edge of the stack of media that is opposite the first edge.

13. The system of claim 12, wherein the second and third measurements are averaged and the difference between first measurement and the average of the second and third measurements is used to calculate the curvature of the stack of media.

14. The system of claim 8 further comprising a memory configured to hold a normal range of curvatures for stack of media and wherein the controller compares the calculated curvature of the stack of media with the normal range of curvatures.

15. The system of claim 14, wherein the printing system issues an error message and does not allow printing when the calculated curvature of the stack of media is not within the normal range of curvatures.

16. The system of claim 14, wherein the printing system adjusts system parameters in order to compensate when the calculated curvature of the stack of media is not within the normal range of curvatures.

* * * * *